US009249639B2

(12) United States Patent
Rankin

(10) Patent No.: US 9,249,639 B2
(45) Date of Patent: Feb. 2, 2016

(54) DRILLING FLUID DIVERTING SUB

(75) Inventor: E. Edward Rankin, Granbury, TX (US)

(73) Assignee: Rite Increaser, LLC, Granbury, TX (US)

( * ) Notice: Subject to any disclaimer, the term of this patent is extended or adjusted under 35 U.S.C. 154(b) by 872 days.

(21) Appl. No.: 13/341,391

(22) Filed: Dec. 30, 2011

(65) Prior Publication Data

US 2012/0175106 A1 Jul. 12, 2012

Related U.S. Application Data

(60) Provisional application No. 61/430,877, filed on Jan. 7, 2011.

(51) Int. Cl.

| | |
|---|---|
| ***E21B 43/00*** | (2006.01) |
| ***E21B 7/00*** | (2006.01) |
| ***E21B 34/00*** | (2006.01) |
| ***E21B 21/10*** | (2006.01) |
| ***E21B 10/18*** | (2006.01) |
| ***E21B 10/61*** | (2006.01) |
| ***E21B 34/10*** | (2006.01) |

(52) U.S. Cl.
CPC ..... *E21B 21/103* (2013.01); *E21B 10/18* (2013.01); *E21B 10/61* (2013.01); *E21B 34/10* (2013.01)

(58) Field of Classification Search
CPC ..... E21B 10/18; E21B 10/61; E21B 34/10; E21B 21/103
USPC ..... 166/222, 223, 325, 332.6, 334.4, 311; 175/324, 339, 57
See application file for complete search history.

(56) References Cited

U.S. PATENT DOCUMENTS

| | | | | |
|---|---|---|---|---|
| 2,804,281 | A * | 8/1957 | Osburn | 137/551 |
| 3,804,186 | A * | 4/1974 | Schoeffler | 175/317 |
| 4,540,055 | A | 9/1985 | Drummond et al. | |
| 4,687,066 | A * | 8/1987 | Evans | 175/340 |
| 4,984,633 | A | 1/1991 | Langer et al. | |
| 5,141,051 | A | 8/1992 | Lenhart | |
| 5,653,298 | A | 8/1997 | Dove et al. | |
| 5,862,871 | A | 1/1999 | Curlett | |
| 6,189,631 | B1 | 2/2001 | Sheshtawy | |
| 7,775,392 | B2 | 8/2010 | Millsap et al. | |
| 8,435,015 | B2 * | 5/2013 | Brookbank et al. | 417/369 |
| 2004/0118614 | A1 | 6/2004 | Galloway et al. | |
| 2011/0232970 | A1 * | 9/2011 | Miller et al. | 175/57 |
| 2012/0043087 | A1 * | 2/2012 | Torres | 166/311 |

FOREIGN PATENT DOCUMENTS

| | | |
|---|---|---|
| WO | WO2006059066 | 6/2006 |

* cited by examiner

*Primary Examiner* — Jennifer H Gay
*Assistant Examiner* — George Gray
(74) *Attorney, Agent, or Firm* — Bracewell & Giuliani LLP

(57) ABSTRACT

A well drilling sub has a body with a threaded upper end for connection into a drill pipe string and a threaded lower end for connection and rotation with an earth boring bit. An axial passage in the body conveys drilling fluid to an outlet in the earth boring bit. Diverting nozzles in the body are in fluid communication with the axial passage. Each nozzle diverts and discharges a portion of the drilling fluid being pumped down the axial passage. Each diverting nozzle has a nozzle axis that points upward and outward and also at a oblique angle. The oblique angle lags a radial plane considering a direction of rotation of the body.

11 Claims, 3 Drawing Sheets

DRILLING FLUID DIVERTING SUB

CROSS-REFERENCE TO RELATED APPLICATION

This application claims priority to provisional application Ser. No. 61/430,877, filed Jan. 7, 2011.

FIELD OF THE DISCLOSURE

This application relates to earth boring operations, and in particular to upward and outward pointing drilling fluid diverting nozzles located in the drill string above the bit.

BACKGROUND OF THE DISCLOSURE

Oil and gas wells are typically drilled with a drill string having a drill bit on bottom that is rotated. One type of drill bit is a drag bit having blades with cutting disks that scrape against and cut the formation. Mud pumps on the drilling rig pump drilling fluid down the drill string and out nozzles on the bit face to sweep formation cuttings from the bit face. The drilling fluid entrains the cuttings and returns up an annulus surrounding the drill string. Particularly for horizontal wells, a mud motor may be to rotate the bit. Drilling fluid pressure powers the mud motor to rotate the bit independently of the drill string rotation. The mud motor requires a considerable pressure and flow rate of drilling fluid in order to be able to apply the desired torque to the drill bit.

If the cuttings are not readily removed, the rate of penetration of the drill bit declines. Bits may also plug and ball up while drilling sticky shale formations. If the mud motor is not able to rotate the drill bit at a desired rotational speed, the rate of penetration may decline. Many variations in the bit nozzle diameters, orientation and placement are used in order to more effectively remove cuttings.

SUMMARY

The well drilling apparatus has a body with a threaded upper end for connection into a drill pipe string having an earth boring device at a lower end. An axial passage in the body conveys drilling fluid to an outlet in the earth boring device. A plurality of diverting nozzles are located in a side wall of the body. Each diverting nozzle is in fluid communication with the axial passage and has an outlet pointing outward and upward from the body for diverting and discharging a portion of the drilling fluid being pumped down the axial passage.

Each fluid diverting nozzle may have a nozzle passage containing a helical set of grooves therein. Each of the nozzle outlets may also point at a oblique angle relative to a vertical plane extending radially from the body axis. The oblique angle of one of the nozzle outlets may differ from the oblique angle of at least one other of the nozzle outlets.

Preferably the body of the sub rotates in unison with the earth boring device during drilling operations. Each nozzle axis rotationally lags a vertical plane extending radially from the body axis and intersecting the nozzle axis at the nozzle outlet.

The body of the sub may have a threaded lower end for threaded connection to the earth boring device. Alternately, the body of the sub may be integrally formed with the earth boring device.

A check valve may be installed in the axial passage to allow downward flow of the drilling fluid and prevent upward flow of the drilling fluid through the axial passage. Optionally, dimples may be formed on an exterior portion of the body to enhance turbulence of the drilling fluid flowing past the body. The outlet of at least one of the nozzles may be closer to the threaded upper end of the body than at least one other of the nozzles.

DETAILED DESCRIPTION

Figure 1:
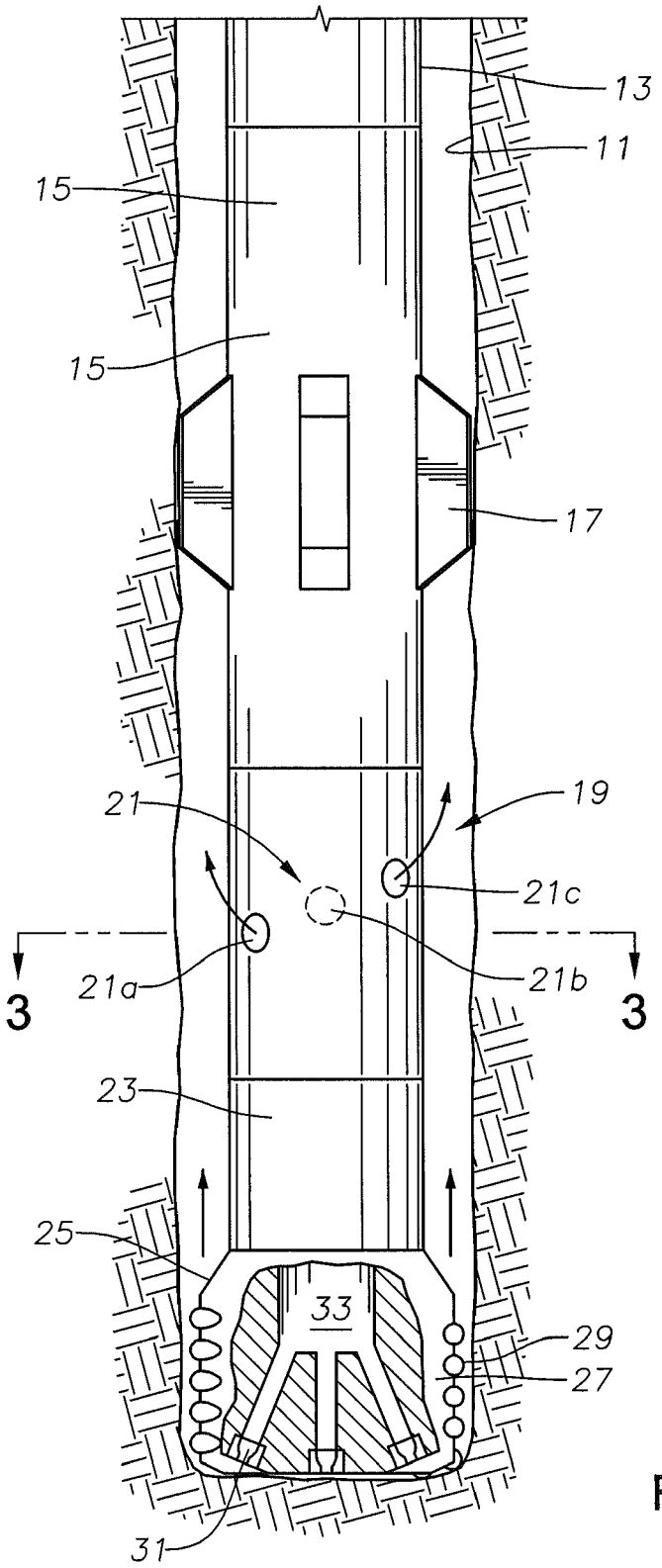
FIG. 1 is a side elevational and partly sectioned view of a drill string having a drilling fluid diverting sub in accordance with this disclosure.

Referring to FIG. 1, a well bore 11 is illustrated being drilled by a drill string 13. Although well bore 11 is shown as being vertical, often it will have a horizontal portion. In this example, drill string 13 includes a mud motor 15, which is a conventional component. Mud motor 15 typically has stabilizers 17 extending from its outer side. A drilling fluid or drilling mud diverting sub 19 is secured to the lower end of mud motor 15. Sub 19 has diverting nozzles 21 in its side wall that have outlets pointing outward and upward. Sub 19 may be joined to an upper end 23 of a conventional earth boring device or bit 25.

In this example, bit 25 is a drag bit having cutting blades 27 extending from a circumference to a lower side or face. Blades 27 have cutting elements 29 mounted thereto for scraping the earth formation as bit 25 rotates. Cutting elements 29 may be formed of a polycrystalline diamond or other materials. Bit 25 also has at least one, and normally several outlets or bit nozzles 31 on its face. Bit outlets 31 receive drilling fluid pumped into a central cavity of bit 25 and discharge the drilling fluid at various angles relative to the face of bit 25. The discharged drilling fluid entrains cuttings of the earth formation and flows up an annulus surrounding drill string 13.

Drilling fluid diverting nozzles 21 in sub 19 discharge a portion of the drilling fluid being pumped down drill string 13 before the drilling fluid reaches bit 25. The flow from nozzles 21 joins the fluid stream of drilling fluid being pumped out of bit nozzles 31. In this embodiment, there are three fluid diverting nozzles 21, these being nozzle 21*a*, nozzle 21*b*, and nozzle 21*c*. Nozzles 21*a*, 21*b* and 21*c* are equally spaced around the side wall of sub 19, 120 degrees apart from each other. More or fewer nozzles 21 is feasible.

Figure 2:
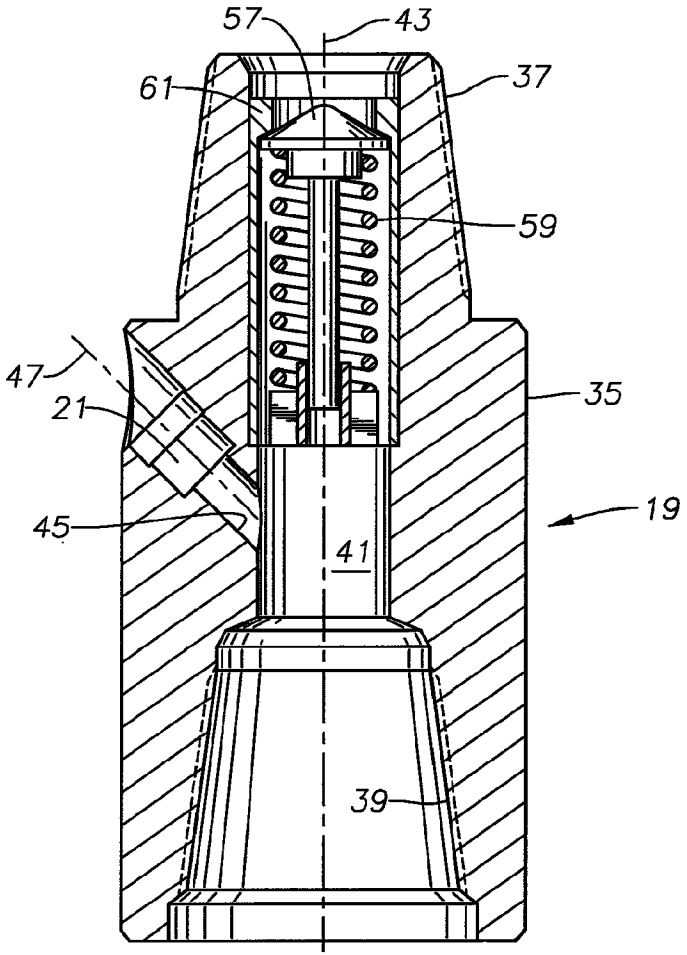
FIG. 2 is a vertical sectional view of the drilling fluid diverting sub of FIG. 1.

Referring to FIG. 2, sub 19 has a tubular body 35 with a threaded upper end 37 for securing to a threaded lower end of mud motor 15 (FIG. 1). Sub 19 may also have a threaded lower end 39 for securing to threaded upper end 23 of bit 25. Alternately, sub 19 could be integrally formed with and be a part of bit upper end 23. An axial passage 41 extends through sub body 35 along a longitudinal axis 43. For each nozzle 21, a diverting nozzle passage 45 joins axial passage 41 and extends upward and outward along a nozzle axis 47 to the exterior of sub body 35. In this example, nozzle axis 47 is oriented upward about 45 degrees, but different angles are feasible.

Figure 3:
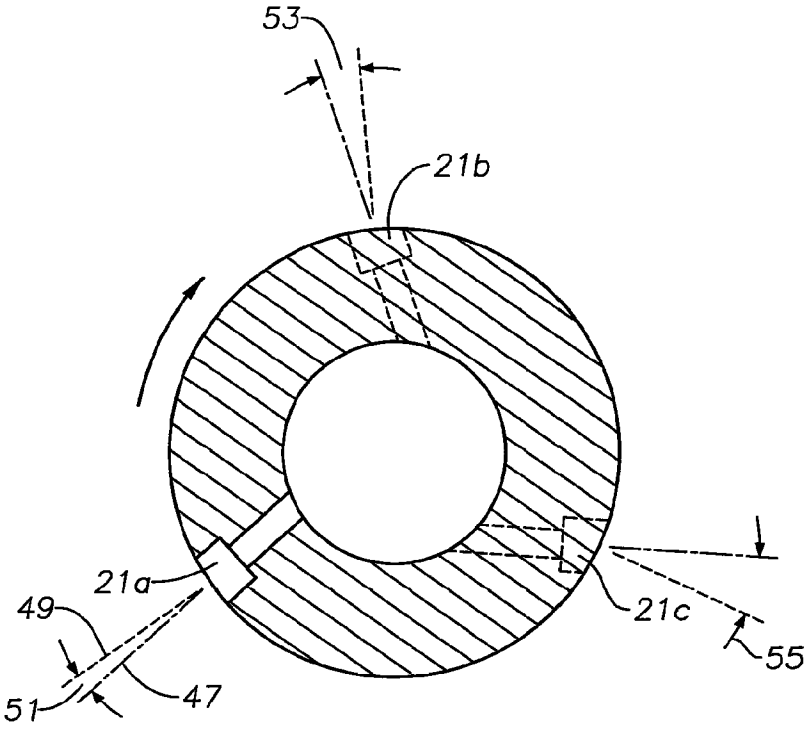
FIG. 3 is a horizontal sectional view of the drilling fluid diverting sub of FIG. 1, taken along the line 3-3 of FIG. 1.

Referring to FIG. 3, an axial or vertical plane 49 is illustrated as emanating from and containing longitudinal axis 43 and also passing through the center of the outlet of each nozzle 21. In this embodiment, nozzle axis 47 is not located within axial plane 49, rather it intersects axial plane 49 at the outlet of nozzle 21. The angular difference between nozzle axis 47 and axial plane 49 is referred to herein as an oblique angle and indicated by the numerals 51, 53 and 55 for nozzles 21*a*, 21*b* and 21*c*, respectively. Unlike axial plane 49, a vertical plane containing nozzle axis 47 would not be normal to the cylindrical exterior of body 35. Nozzle axis 47 thus is oblique to the cylindrical exterior of body 35, in addition to pointing upward and outward. Considering the direction of rotation, which is clockwise looking down as shown by the arrow, each nozzle axis 47 lags axial plane 49.

In this embodiment, oblique angle 51 for nozzle 21*a* is less than oblique angle 53 for nozzle 21*b*, which in turn may be less than oblique angle 55 for nozzle 21*c*. In one example, oblique angle 51 is 10 degrees, oblique 53 is 20 degrees, and oblique angle 55 is 30 degrees. Different oblique angles may be employed. Further, it is not essential that each oblique angle differ; rather one oblique angle could differ from only one other oblique angle or all of the oblique angles may be the same.

Also, in this embodiment, each nozzle 21 is at a different elevation than the others. For example, as shown in FIG. 1, nozzle 21*a* is the lowest, or closest to drill bit 25. Nozzle 21*b* is farther from drill bit 25 than nozzle 21*a*. Nozzle 21*c* is farther from drill bit 25 than nozzle 21*c*. The difference in distance to drill bit 25 can vary. In one example, the difference is about ⅜ inch from nozzle 21*a* to nozzle 21*b* and the same amount from nozzle 21*b* to nozzle 21*c*. The lowest nozzle, which is nozzle 21*a*, may have the smallest oblique angle 51, as shown in FIG. 3. It is not essential that the elevations for each nozzle 21 differ. For example, the distance to bit 25 may differ between only two of the nozzles 21, or all of the elevations could be the same.

Referring again to FIG. 2, a check valve 57 may optionally be inserted into an upper portion of axial passage 41. Check valve 57 may be of various types. In this example, a check valve element is biased by a spring 59 against a seat in a cartridge 61. Cartridge 61 rests on a shoulder in the upper portion of axial passage 41, which is slightly larger in diameter than the central portion that is intersected by nozzle passages 45. Check valve 57 allows down flow of fluid in axial passage 41, but blocks upward flow. When running drill string 13 into the well bore 11, check valve 53 resists silt and cuttings from passing upward through bit outlets 31 to mud motor 15, where damage may occur.

Figure 4:
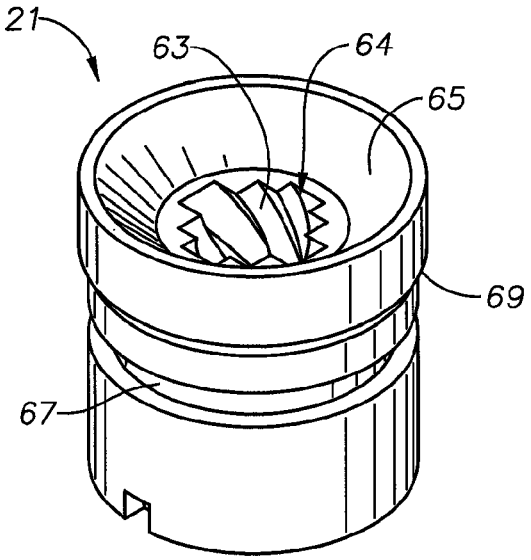
FIG. 4 is a perspective view of one of the nozzles of the drilling fluid diverting sub of FIG. 1.
Figure 6:
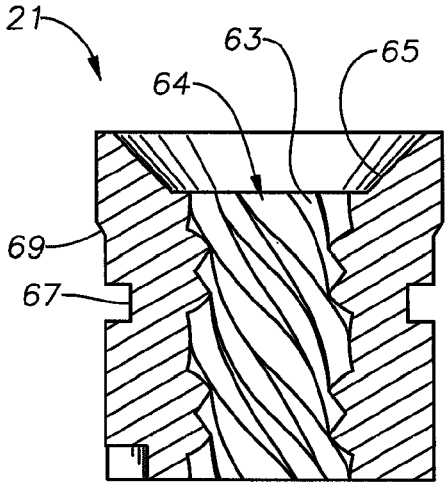
FIG. 6 is a sectional view of the nozzle of FIGS. 4 and 5.
Figure 5:
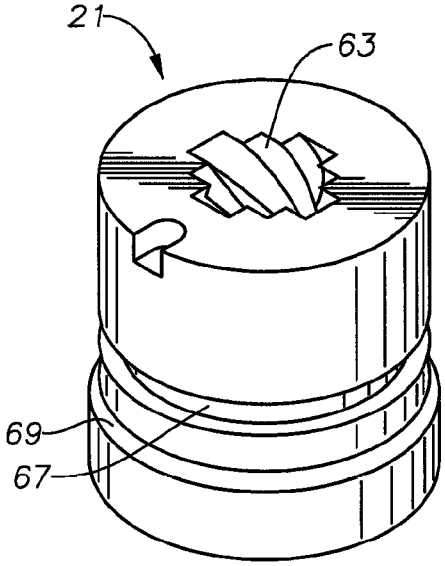
FIG. 5 is a perspective view of the nozzle of FIG. 4, as seen from a different view point.

Referring to FIGS. 4-6, each nozzle 21 may have helical grooves 63 formed in its bore or outlet 64. Grooves 63 spiral from one end to the other of outlet 64. The helical angle may vary.

Also, FIG. 4 shows that the outer end of each nozzle 21 may have a conical recess 65 that diverges outward. Each nozzle 21 has an o-ring seal groove 67 on its outer diameter for sealing within nozzle passage 45 (FIG. 2). Nozzles 21 may be retained in various conventional manners. A retainer ring shoulder 69 receives a snap ring to retain nozzle 21 in this example.

Figure 7:
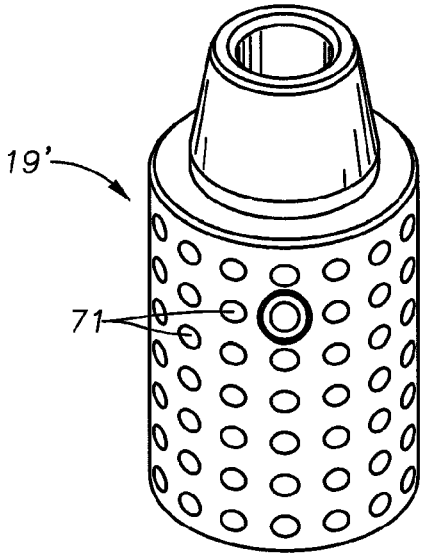
FIG. 7 is a perspective view of an alternate embodiment of the drilling fluid diverting sub of FIG. 1.

Referring to FIG. 7, substantially the entire exterior of fluid diverting sub 19' may have protrusions or dimples 71 formed therein. Dimples 71 serve to enhance turbulence of drilling fluid flowing past sub 19'.

In operation, fluid diverting sub 19 is secured into drill string 13 between drill bit 25 and mud motor 15. Alternately, fluid diverting sub 19 may form an upper part of drill bit 25. If the operator wishes to test mud motor 15 before lowering the string into well bore 11, and if fluid diverting sub 19 is connected between mud motor 15 and drill bit 25, the operator will install blank plugs in nozzle passages 45 in place of nozzles 21. The blank plugs allow the operator to pump drilling fluid through mud motor 15 and out bit outlets 31 to test whether mud motor 15 properly rotates drill bit 25.

After testing, the operator installs nozzles 21 in fluid diverting sub 19. The operator can select different diameters for the bores of diverting nozzles 21 so as to create a desired flow area ratio to the bit nozzles or outlets 31. The total flow areas of the diverting nozzles 21 will be fairly small relative to the total flow areas of the bit outlets 31. Typically, the cumulative diverting nozzle flow area will be only 10 to 20 percent of the cumulative flow area of bit outlets 31.

Once the nozzles 21 are installed, the operator lowers the drill string 13 into well bore 11. When reaching the bottom of well bore 11, the operator rotates drill bit 25 to begin drilling while also pumping drilling fluid down drill string 13. The operator can rotate drill bit 25 by rotating drill string 13 from the drilling rig. The operator can also hold drill string 13 stationary, and the drilling fluid flowing through mud motor 15 will rotate drill bit 25 and fluid diverting sub 19 in unison with each other. When drilling horizontal wells, the operator may use both procedures at various times. Mud motor 15 is optional for certain drilling operations, such as vertical portions of the well. In those instances, mud motor 15 may be eliminated and fluid diverting sub 19 may connect to a lower end of drill string 13, such as the drill collars.

The drilling fluid flows into bit cavity 33 and out bit outlets 31. The drilling fluid returns back up the annulus surrounding drill string 13, bringing earth formation cuttings. A portion of the drilling fluid is diverted out through diverting nozzles 21. The upward and outward directed drilling fluid mixes with the returning drilling fluid discharged from bit outlets 31, creating turbulence and enhancing the retention of cuttings in the flow stream. The jets of drilling fluid exiting fluid diverting nozzles 21 will swirl due to the helical grooves 63 (FIG. 4).

The fluid diverting sub has many advantages. Better removal of cuttings from the well bore increases the rate of penetration of the bit. The fluid diverting nozzles create a dynamic pressure in the returning fluid to speed up the flow rate. By rotating with the bit, the fluid diverting nozzles sweep a full 360 degrees. The fluid diverting nozzles reduce balling up of the bit face and stick-slip. The fluid diverting sub may help prevent drill bit plugging, increase mud motor bearing life, and help directional drilling characteristics. An enhanced cuttings removal allows the mud motor to rotate the bit at a higher rotational speed, thus increasing the rate of penetration.

While the disclosure has been shown in only a few of its forms, it should be apparent to those skilled in the art that it is not so limited but is susceptible to various changes without departing from the scope of the disclosure.

The invention claimed is:

1. A well drilling apparatus, comprising:

a body having a longitudinal body axis, a threaded upper end for connection into a drill string having an earth boring device at a lower end;

an axial passage in the body concentric with the axis for conveying drilling fluid to an outlet in the earth boring device;

a plurality of diverting nozzles in the body, each in fluid communication with the axial passage via a nozzle port, each of the nozzle ports extending between the axial passage and one of the nozzles and being continuously open, and each of the nozzles having a nozzle outlet pointing outward and upward from the body for diverting and discharging a portion of the drilling fluid being pumped down the axial passage; wherein the body is adapted to be rotated in unison with the earth boring device during drilling operations;

each of the nozzle outlets having a nozzle axis that rotationally lags a vertical plane extending radially from the body axis and intersecting the nozzle axis at the nozzle outlet; and the nozzle outlets are located on a cylindrical exterior portion of the body that is free of any structure protruding from the cylindrical exterior portion between adjacent ones of the nozzle outlets.

2. The apparatus according to claim 1, wherein each of the nozzles has a nozzle passage therethrough, each of the nozzle passages having a helical set of grooves therein.

3. The apparatus according to claim 1, further comprising an internally threaded lower end on the body for threaded connection to the earth boring device.

4. In a well drilling apparatus having a drill string with an earth boring bit at a lower end, the improvement comprising:

a body having a longitudinal body axis, an externally threaded upper end for connection into a drill string and an internally threaded lower end connected directly to the bit for rotation therewith;

an axial passage in the body and concentric with the axis for conveying drilling fluid to an outlet in the earth boring bit;

a plurality of nozzle ports in the body, each of the nozzle ports joining and extending outward from the axial passage;

a plurality of diverting nozzles in the body, each of the nozzles being mounted in one of the nozzle ports and having a nozzle outlet for diverting and discharging a portion of drilling fluid being pumped down the axial passage;

the nozzle ports being continuously open for discharging drilling fluid through the nozzles whenever drilling fluid is pumped down the axial passage;

each of the nozzle outlets having a nozzle axis that points upward and outward and also at an oblique angle relative to a vertical plane of the body axis that intersects the nozzle axis at the nozzle outlet, the oblique angle lagging the vertical plane considering a direction of rotation of the body; wherein each of the nozzle outlets is located in an exterior cylindrical portion of the body extending 360 degrees around the axis, the exterior cylindrical portion being free of any outward protruding structure located between adjacent ones of the nozzles; and each of the nozzles has helical internal grooves.

5. The apparatus according to claim 4, further comprising:

a plurality of blades protruding outward from the drill string above the earth boring bit; and wherein all of the blades are located above all of the nozzles.

6. The apparatus according to claim 4, further comprising:

a mud motor mounted into the drill string above the body for imparting rotation to the body and the earth boring bit in response to drilling fluid pumped down the drill string.

7. The apparatus according to claim 4, further comprising:

a plurality of blades protruding outward from the drill string, all of the blades being located above all of the nozzles; and a mud motor mounted into the drill string above the body and the blades for imparting rotation to the body and the earth boring bit in response to drilling fluid pumped down the drill string.

8. A method of drilling a well, comprising:

(a) providing a drill string with a body having a longitudinal body axis and an earth boring device at a lower end of the drill string, the body having an axial passage concentric with the axis and a plurality of diverting nozzles, each being in fluid communication with the axial passage via a nozzle port that is continuously open, each of the diverting nozzles having a nozzle outlet pointing outward and upward from a cylindrical exterior portion of the body, each of the nozzle outlets having a nozzle axis that rotationally lags a vertical plane extending radially from the axis and intersecting the nozzle axis at the nozzle outlet, the cylindrical exterior potion of the body being free of any outward protruding structure between adjacent one of the nozzle oulets;

(b) lowering the drill string into the well, rotating the earth boring device and the body in unison to drill the well, while rotating the earth boring device, pumping drilling fluid down the drill string and discharging the drilling fluid out at least one outlet in the earth boring device, which returns up an annulus surrounding the drill string; and (c) while rotating the drill string, diverting and discharging a portion of the drilling fluid being pumped down the drill string out the diverting nozzles into the annulus to facilitate a return of the drilling fluid.

9. The method according to claim 8, wherein:

step (a) comprises mounting a plurality of outward protruding blades in the drill string, all of the blades being located above all of the nozzle outlets.

10. The method according to claim 8, wherein:

step (a) further comprises providing each of the diverting nozzles with helical internal grooves; and step (c) comprises with the helical internal grooves, swirling the drilling fluid flowing out the diverting nozzles.

11. The method according to claim 8, wherein:

step (a) comprises providing the drill string with a mud motor for rotating the earth boring device relative to the drill string; and step (a) comprises mounting the body between the earth boring device and the mud motor.

* * * * *